US005195916A

United States Patent [19]

Her

[11] Patent Number: 5,195,916

[45] Date of Patent: Mar. 23, 1993

[54] DUAL DISC FLYING TOY WITH FLAT LOWER MEMBER

[76] Inventor: Ming-Long Her, No. 24, Alley 3, Lane 42, Sec. 2, Hsiang Shang Rd., Taichung, Taiwan

[21] Appl. No.: 905,224

[22] Filed: Jun. 29, 1992

Related U.S. Application Data

[63] Continuation of Ser. No. 695,338, May 3, 1991, abandoned.

[51] Int. Cl.[5] ..... A63H 27/00; A63H 27/127; A63B 65/10

[52] U.S. Cl. ..... 446/46; 446/48; 446/255; 273/424

[58] Field of Search ..... 446/46, 47, 48, 34, 446/36, 61, 66, 67, 120, 236, 255; 273/424, 425, 428, 317

[56] References Cited

U.S. PATENT DOCUMENTS

| | | | |
|---|---|---|---|
| 3,802,117 | 4/1974 | Englehardt | 446/46 |
| 3,935,663 | 2/1976 | Leibowitz | 446/48 |
| 3,939,602 | 2/1976 | Burke et al. | 446/48 |
| 4,117,626 | 10/1978 | Kifferstein et al. | 446/47 |
| 4,182,073 | 1/1980 | Tabet | 446/46 |
| 4,184,284 | 1/1980 | Rogahn | 446/48 X |
| 4,246,720 | 1/1981 | Stone | 446/47 |
| 4,306,373 | 12/1981 | Chatani et al. | 446/121 |
| 4,307,538 | 12/1981 | Moffitt | 446/47 |
| 4,425,734 | 1/1984 | Bauer | 446/48 |
| 4,752,267 | 6/1988 | Layman | 446/46 |
| 4,846,749 | 7/1989 | Petko | 446/47 X |
| 4,955,842 | 9/1990 | Marcotti | 446/46 |
| 5,066,258 | 11/1991 | Tumberlin | 273/424 X |
| 5,080,624 | 1/1992 | Brinker | 446/36 X |
| 5,100,356 | 3/1992 | Atwell | 446/48 |

*Primary Examiner*—D. Neal Muir
*Attorney, Agent, or Firm*—Bacon & Thomas

[57] ABSTRACT

A toy flying saucer comprising a smaller top disc attached to a large base disc at the top. The top disc has a cylindrical connecting end projecting from the bottom edge thereof, which cylindrical connecting end has an annular projection around the outer wall surface thereof inserted to engage in the annular groove around the inner wall surface of the cylindrical connecting end at the top of the base disc. The top disc has a wind resisting surface wider than that of the base disc, which permits the toy flying saucer to automatically turn into a normal position and keep flying in such a normal position once it has been thrown to the air.

2 Claims, 4 Drawing Sheets

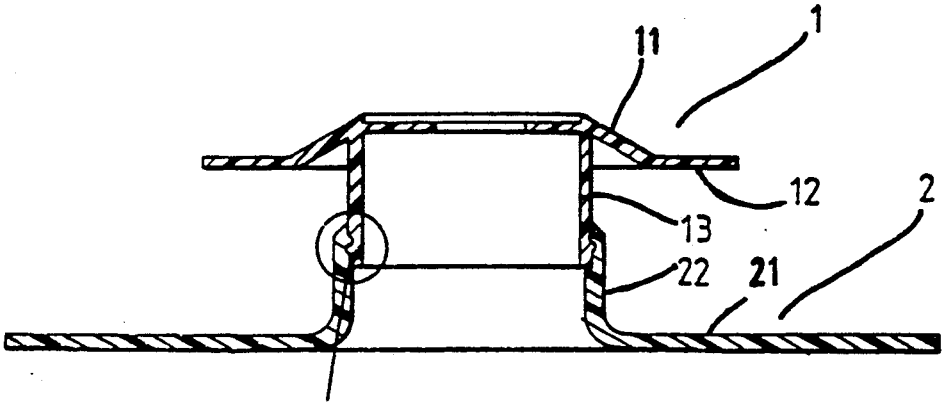
FIG. 3A
FIG. 3
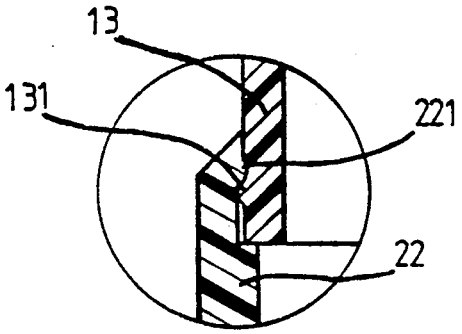
FIG. 3A

DUAL DISC FLYING TOY WITH FLAT LOWER MEMBER

This application is a continuation of application Ser. No. 07/695,338 filed May 3, 1991, abandoned.

BACKGROUND OF THE INVENTION

The present invention relates to a toy flying saucer and relates more particularly to such a toy flying causer which will automatically turn into a normal position and keep flying in such a normal position once it is thrown in the air.

In order to reduce possible wind resistance so as to keep flying longer, regular toy flying discs are generally made in a flat, thin and round shape with a recessed hole disposed at the bottom. This structure is no longer attractive. Further, while throwing a conventional toy flying disc, the recessed hole therein must be disposed at the bottom. If a conventional toy flying disc is turned upside-down while throwing to the air, it will not fly through the air in a stable manner.

SUMMARY OF THE INVENTION

The present invention has been, accomplished with the circumstances under consideration. It is therefore the above main object of the present invention to provide a toy flying causer which will automatically turn into a normal position to keep flying through the air in a stable manner once it has been thrown in the air.

According to the first aspect of the present invention, a toy flying saucer is generally comprised of a small top disc fastened in a large base disc at the top thereof, wherein the top disc has a cylindrical connecting end projecting from the bottom edge thereof, which cylindrical connecting end has an annular projection around the outer wall surface thereof inserted to engage in the annular groove around the inner wall surface of a cylindrical socket at the top of the base disc.

According to a second aspect of the present invention, a toy flying saucer is generally comprised of a small top disc fastened in a large base disc at the top, wherein the top disc has a top surface that is curved outwardly; the base disc is made with an outer diameter and weight relatively larger and heavier than the top disc.

According to a third aspect of the present invention, a top flying saucer is generally comprised of a small top disc fastened in a large base disc at the top, wherein the base disc has a wind resisting surface smaller than that of the top disc during flying of the saucer through the air.

BRIEF DESCRIPTION OF THE DRAWINGS

FIG. 3 is a sectional view thereof;

DETAILED DESCRIPTION OF THE PREFERRED EMBODIMENT

Figure 1:
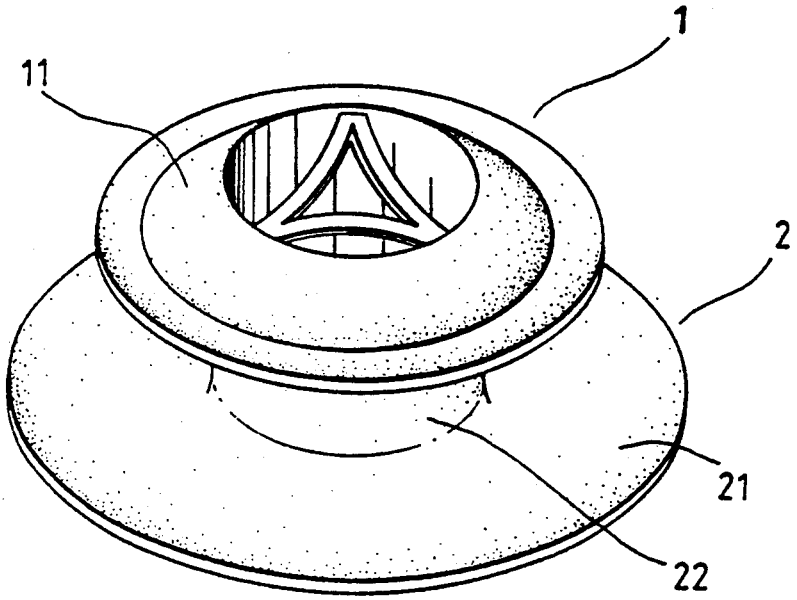
FIG. 1 is a perspective view of a toy flying saucer embodying the present invention.
Figure 2:
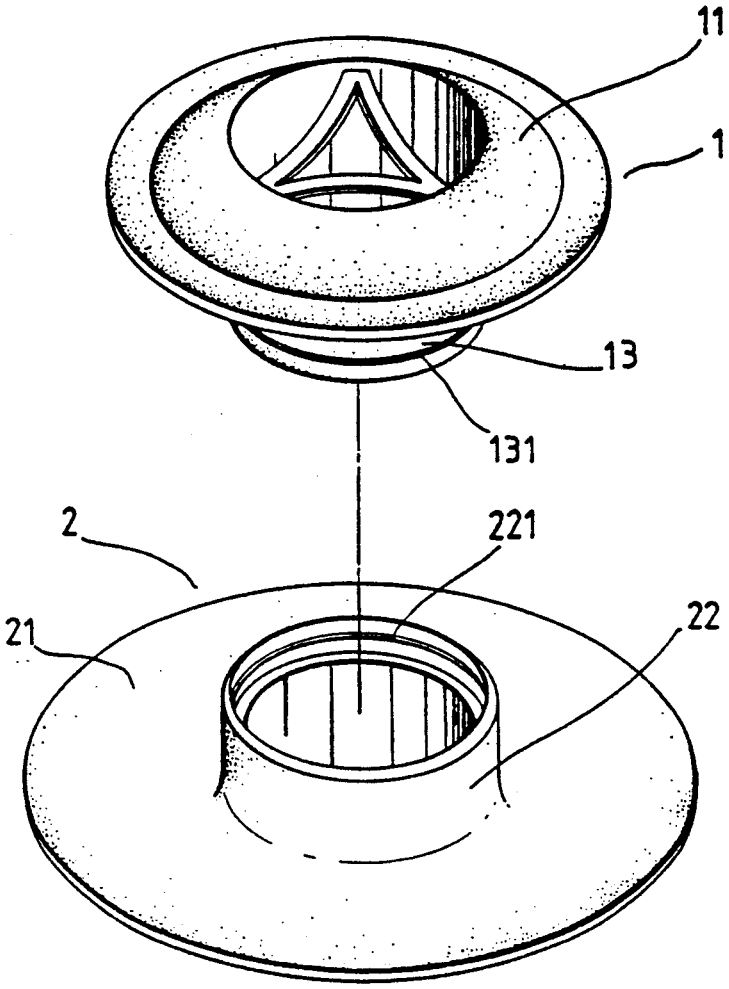
FIG. 2 is an exploded perspective view thereof.

Referring to FIGS. 1 and 2, a top flying saucer in accordance with the present invention comprises a top disc 1 mounted on a base disc 2 at the top thereof. The top disc 1 has an arched top surface 11 at the top and a hollow cylindrical connecting end 13 extending downwards from the bottom surface 12 thereof, which ring-shaped cylindrical connecting end 13 has an outwardly extending annular projection 131 around the lower periphery thereof. The base disc 2 is made in a substantially flat, thin, round structure having a unitary, cylindrical socket 22 raising from the top surface 21 thereof at the center. The cylindrical socket 22 has an annular groove 221 around the inner wall surface thereof for engagement by the annular projection 131 on the ring-shaped connecting end 13 of the top disc 1. By fastening the annular projection 131 in the annular groove 221, as shown in FIG. 3, the top disc 1 is firmly secured to the base disc 2.

Figure 4:
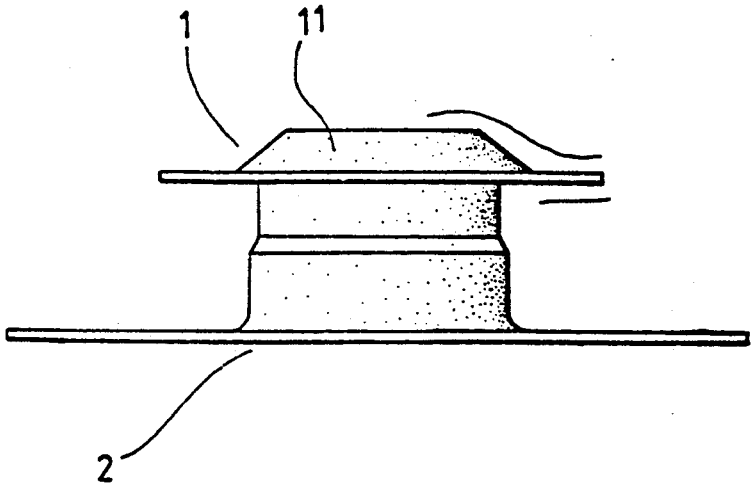
FIG. 4 is a side elevation thereof, showing that a pressure difference occurs when a stream of air passes along the top and bottom surfaces of the top disc.

Referring to FIG. 4, because the outer diameter of the top disc 1 is relatively smaller than the base disc 2, the center of gravity of the whole assembly is shifted to a lower position once the top disc 1 is attached to the base disc 2. Because the top surface 11 of the top disc 1 is shaped like a dome and the bottom surface 12 thereof is a flat surface, a pressure difference will occur when a stream of air passes along the top surface 11 and the bottom surface 12 of the top disc, which pressure difference enables the top flying causer to float int he air for a longer length of time.

Figure 5:
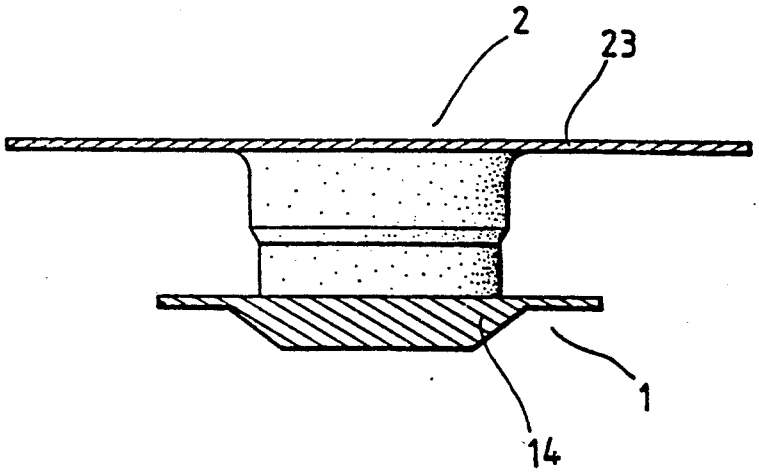
FIG. 5 is a side elevation thereof showing the respective wind resisting areas on the base disc and the top disc by which the top flying saucer will be forced, while flying through the air, to turn or revert to a normal position with the top disc disposed at the top and the base disc disposed at the bottom.

Referring to FIG. 5, because the transverse cross-sectional wind resisting area 14 on the top disc 1 is much wider than the transverse cross-sectional wind resisting area 23 on the base disc 2 (as shown in the shadowed portions in FIG. 5) and the center of gravity of the toy flying saucer is shifted to a location within the base disc 2, the top flying saucer will be forced to turn over or revert itself into a correct position with the top disc 1 thereof disposed at the top and the base disc 2 thereof disposed at the bottom during flying, if the toy flying causer is thrown to fly through the air in an upside-down position.

As indicated, the present invention is to provide a toy flying saucer which is permitted to fly longer when it is thrown to the air and, which will automatically turn over or revert itself into a normal position with its top disc disposed at the top to fly through the air in a stable manner even if it is thrown into the air in an upside-down position.

What is claimed is:

1. A causer-shaped flying toy comprising:

a) a circular base disc having a substantially flat and thin configuration, a top connecting portion extending upwardly from a top surface of the base disc at the center thereof, and the top connecting portion including an inner wall surface and an annular groove formed around the inner wall surface;

b) a circular top disc having an arched top surface and a bottom connecting portion extending downwardly from a bottom surface thereof, the bottom connecting portion including an outer wall surface and an annular projection around the outer wall surface, and the top disc being configured to provide an aerodynamic lift exceeding that of the base disc;

c) the annular projection of the bottom connection portion being engaged within the annular groove of the top connecting portion to secure the top disc to the base disc; and d) the outer diameter and weight of the base disc exceeding the outer diameter and weight of the top disc to disposed the center of gravity of the toy in the base disc, thereby permitting the toy to always right itself and maintain a normal flying position with the top disc being disposed above the base disc when the top is thrown into the air.

2. The saucer-shaped flying top of claim 1 wherein the top and bottom connecting portions are each of a hollow cylindrical configuration.

* * * * *